United States Patent [19]

Pere

[11] 4,358,357

[45] Nov. 9, 1982

[54] APPARATUS FOR THE ELECTROLYSIS OF WATER

[75] Inventor: Gerard Pere, Le Breuil, France

[73] Assignee: Creusot-Loire, Paris, France

[21] Appl. No.: 119,199

[22] Filed: Feb. 6, 1980

[30] Foreign Application Priority Data

Feb. 9, 1979 [FR] France ..... 79 03392

[51] Int. Cl.[3] ..... C25B 9/00; C25B 15/08

[52] U.S. Cl. ..... 204/256; 204/258; 204/266

[58] Field of Search ..... 204/253–258, 204/263–266, 129

[56] References Cited

U.S. PATENT DOCUMENTS

| | | | |
|---|---|---|---|
| 1,199,472 | 9/1916 | Levin | 204/256 |
| 1,799,116 | 3/1931 | Noeggerath | 204/256 |
| 2,717,872 | 9/1955 | Zdansky | 204/258 X |
| 3,836,448 | 9/1974 | Bouy et al. | 204/258 X |
| 4,076,609 | 2/1978 | Mas | 204/258 |

FOREIGN PATENT DOCUMENTS

| | | | |
|---|---|---|---|
| 514391 | 12/1930 | Fed. Rep. of Germany | 204/256 |
| 1246687 | 4/1960 | Fed. Rep. of Germany | 204/258 |
| 1145751 | 3/1969 | United Kingdom | 204/266 |

*Primary Examiner*—Delbert E. Gantz
*Assistant Examiner*—Donald R. Valentine
*Attorney, Agent, or Firm*—Pollock, Vande Sande & Priddy

[57] ABSTRACT

The electrolytic apparatus includes at least one set of cells housed in a stack of annular spacer frames, annular bearing surfaces of which indicate joint planes extending to the exterior of the stack of frames, and each equipped with electrode plates and a diaphragm which forms compartments containing each an electrolyte under pressure brought through at least one supply channel, the gases formed by electrolysis being discharged towards channels, and it is essentially characterized by the fact that with each joint plane extending to the exterior of the stack of frames there is associated at least one annular collector groove arranged in a bearing surface of a frame and associated with discharge means capable of discharging the electrolyte flowing through the said joint plane. The electrodes are bipolar and arranged with a structure reminiscent of the structure of a filterpress.

7 Claims, 3 Drawing Figures

APPARATUS FOR THE ELECTROLYSIS OF WATER

FIELD OF THE INVENTION

The present invention relates to improvements in an apparatus intended for the electrolysis of water in an alkaline environment under pressure.

The electrolytic apparatus in accordance with the invention is an apparatus having bipolar electrodes and equipped with a stack of frames reminiscent of the structure of a filterpress.

BACKGROUND

The principle of an electrolytic apparatus is well known. Such an apparatus includes cells containing an electrolyte and equipped with electrodes. Under the effect of an electrical field established between the electrodes the ions move in the direction of this field towards the said electrodes. The cations move towards the cathode and the anions move towards the anode. When the ions arrive at the electrodes they abandon to them their electrical charge and are transformed into neutral atoms. In the case of the electrolysis of water the electrolyte is water to which potash has generally been added. The reactions at the electrodes lead to the formation of hydrogen at the cathode and oxygen at the anode. Each cathode is separated from the opposite anode by a diaphragm. The water consumed must be replaced. So electrolyte is brought through feed channels at the bottom of the cells. The oxygen gas and the hydrogen gas which are produced at the electrodes are collected at the upper part of the cells.

Various types of apparatus are known which serve for the electrolysis of water. Generally two neighboring electrode plates are separated by at least one annular frame which forms with the said electrode plates one cell containing electrolyte. This cell is divided by the diaphragm into two compartments of which one contains the anolyte and the other the catholyte. The apparatus, because it is provided with a set of electrode plates, includes a stack of frames which are clamped between two clamping plates subjected to a clamping system. Each compartment includes in the upper part an orifice enabling gas to be collected and in the lower part an inlet enabling the introduction of the electrolyte. In certain apparatus each electrode is anodic on one side and cathodic on the other. These electrodes are called bipolar.

Certain bipolar apparatus operate at high temperature and pressure. This operation under pressure procures a better output.

Flow of the electrolyte must be prevented through the joint planes which are formed by the generally plane annular faces of the frames. Such flow would have the consequence of causing corrosion phenomena and pressure differences between the anodic and cathodic compartments. The sealing must be controlled when the operational pressure is high.

SUMMARY OF THE INVENTION

The aim of the present invention is to provide a satisfactory sealing system for an electrolytic apparatus having a structure of filterpress type. This system of sealing enables possible leakages of electrolyte to be collected and recycled. At the same time it avoids leakage of the electrolyte feeding the cells and leakage of the gases formed by the electrolysis. It serves to form a water barrier and serves to detect the leakages. This system is adapted to an electrolytic apparatus operating at a pressure higher than 30 bars and at a temperature higher than 80° C.

The electrolytic apparatus in accordance with the invention includes a set of cells housed in a stack of annular spacer frames, whose annular bearing surfaces indicate joint planes opening out towards the outside, and each equipped with electrode plates and a diaphragm which forms compartments containing each an electrolyte under pressure brought through at least one supply channel, the gases formed by electrolysis being discharged towards channels, and it is essentially characterized by the fact that with each joint plane opening out towards the outside there is associated at least one annular collector groove arranged in a bearing surface of a frame and associated with discharge means capable of discharging the electrolyte flowing through the said joint plane.

In accordance with another characteristic of the invention there is associated with each joint plane an annular distributor groove arranged in a bearing surface of a frame and the perimeter of which is less than the annular collector groove and which is associated with means of feeding with water at a pressure higher than the pressure of the electrolyte.

The invention will now be described by referring to an embodiment given by way of example and represented by the attached drawings.

DETAILED DESCRIPTION

Figure 1:
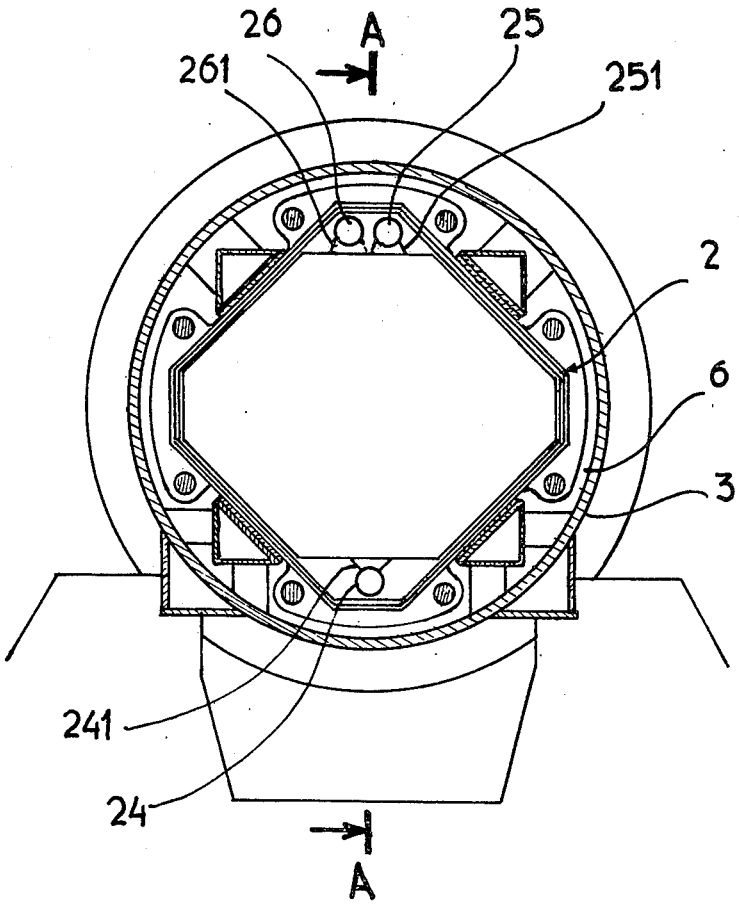
FIG. 1 is a section through the electrolytic apparatus in accordance with the invention.
Figure 2:
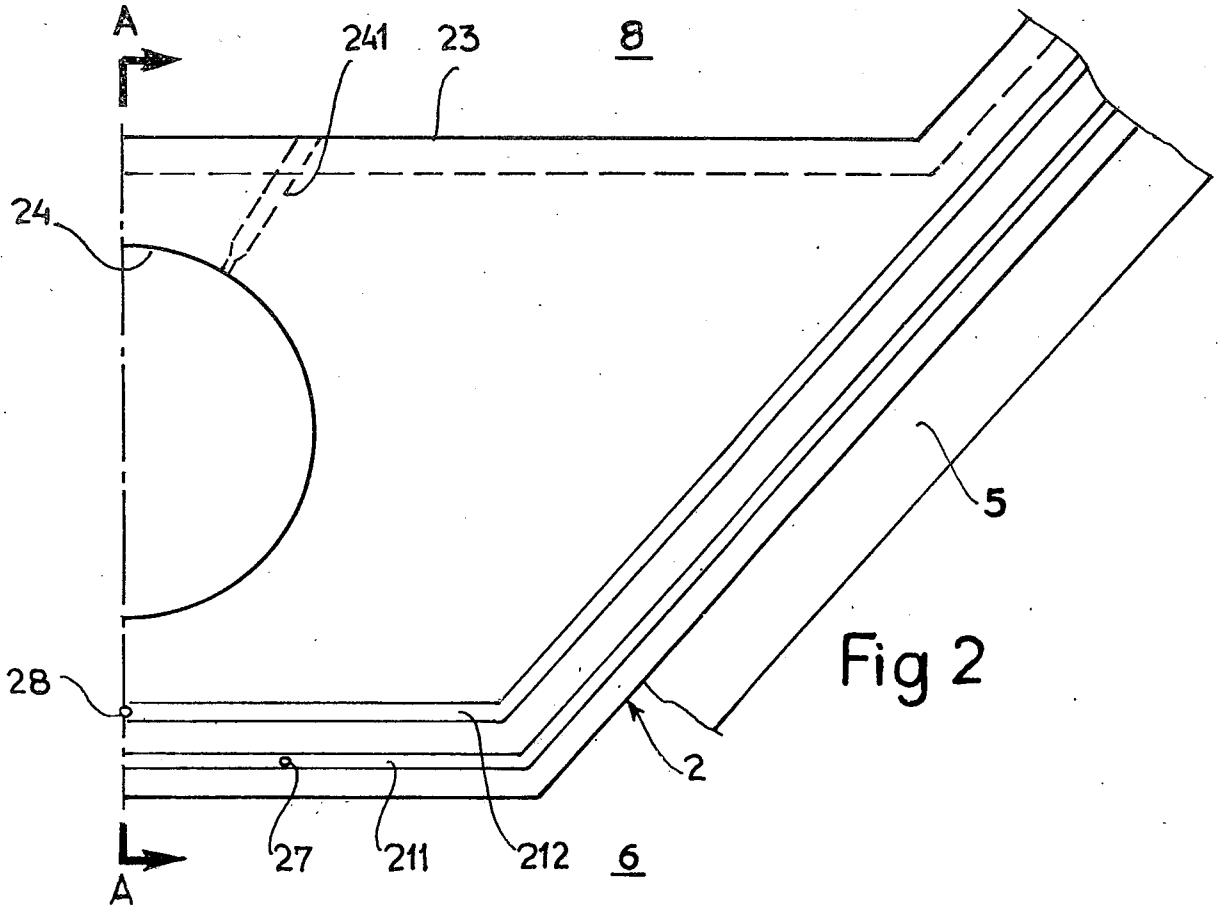
FIG. 2 is a detail from the section represented in FIG. 1.
Figure 3:
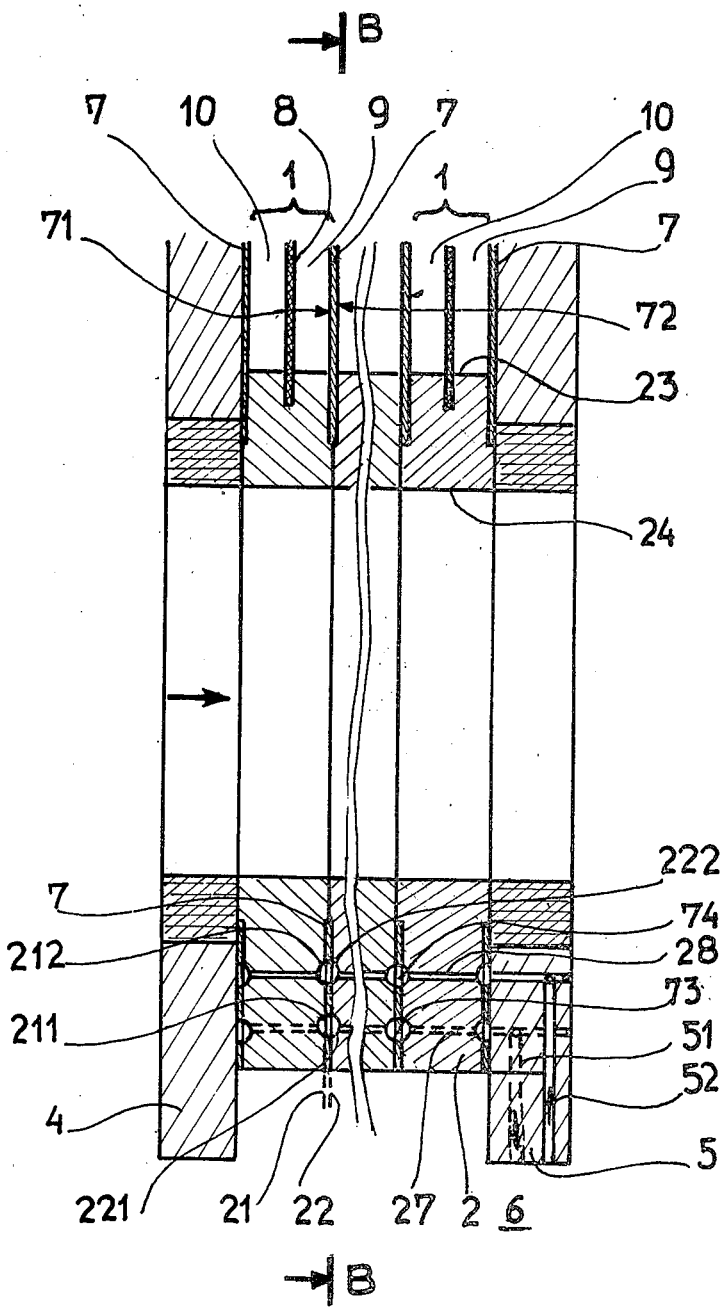
FIG. 3 is a partial view of the section through A—A as FIGS. 1 and 2.

Referring to FIGS. 1 to 3, the apparatus includes a group of electrolytic cells 1 housed in an envelope formed of annular frames 2. This stack of frames 2 is enclosed in an enclosure 3 consisting of a bell and a closure plate. The stack of frames 2 is clamped between two clamping plates 4 and 5 housed inside the enclosure. The volume 6 which lies between the outside of the group of frames and the inside of the enclosure 3 is filled with a gas such as nitrogen at a pressure substantially equal to the pressure of the electrolyte. The two clamping plates 4 and 5 are joined together by tie rods (or an equivalent system) which serve to bring them together while clamping the intermediate parts.

Each spacer frame 2 inserted between the plates 4 and 5 has an annular shape. It is bounded by two generally plane annular bearing surfaces 21 and 22 and it forms a central bore 23. The outer surface of each of these frames may be prismatic or cylindrical and similarly the surface of the central bore 23 may be prismatic or cylindrical.

Each cell is bounded between two electrode plates 7 and comprises a diaphragm 8. The diaphragms and the electrode plates are arranged vertically and alternately along the longitudinal axis of the apparatus. The electrode plates 7 consist, for example, of nickel. The diaphragms 8 advantageously consist of a material resistant to temperature and pressure, for example, asbestos board. The electrode plates and the diaphragms form with the spacer frames a succession of compartments 9 and 10. The compartments 9 contain the anolyte and are located next to the anodic faces 71 of the electrode plates 7. The compartments 10 are arranged alternately with the compartments 9 and contain the catholyte and are located next to the cathodic faces 72 of the electrode plates 7. Each diaphragm 8 closes off the whole of the area of the bore 23 and is engaged at its periphery in an annular groove in a spacer frame. Each electrode plate 7 is inserted between the bearing surfaces 21 and 22 of two spacer frames 2. Its face 71 is in contact with an annular bearing surface 21 of one frame, its face 72 being in contact with an annular bearing surface 22 of another frame. It forms with the two spacer frames which surround it, two parallel joint planes. These two parallel joint planes 21-71 and 21-72 open into the outer chamber 6.

A feed channel 24 which passes through at least one of the clamping plates 4 and 5 supplies the electrolyte to the different electrolytic cells. This channel 24 passes through the whole of the spacer frames 2 horizontally. It is connected to each compartment 9 or 10 by ducts 241.

The hydrogen which is formed at the cathodic face 72 of each electrode 7 rises in the corresponding cathodic compartment and it is collected at the upper part of this compartment through ducts 251. These various ducts 251 open out into a collector channel 25 which extends horizontally over the whole length lying between the plates 4 and 5. The oxygen which is formed at the anodic face 71 of each electrode plate 7 rises in the corresponding anodic compartment and is collected at the upper part in ducts 261. The various ducts 261 open out into a collector channel 26 which extends horizontally over the whole length lying between the plates 4 and 5. These collector channels 25 and 26 pass through the whole of the spacer frames.

With each joint plane formed between one face of an electrode plate and one bearing surface of an adjacent frame 2 there is associated a collector groove referenced 211 or 221. The grooves 211 are associated with the joint bearing surfaces 21 in contact with the anodic faces 71. The grooves 221 are associated with the joint bearing surfaces 22 in contact with the cathodic faces 72. These grooves are inlaid in the plane annular bearing surfaces 21 or 22 of the spacer frames. Two adjacent spacer frames are provided with two collector grooves 211 and 221 which are symmetrical with respect to the plane of symmetry of the intermediate electrode plate. These opposite grooves communicate through one or more orifices 73 which pass through the intermediate electrode plate from side to side. Each collector groove has an annular shape and its perimeter is greater than the perimeter of the bore 23. All of the collector grooves 211 and 221 are connected together by discharge ducts 27 which pass through the annular frames horizontally. Each discharge duct 27 joins together two collector grooves 211 and 221 of one and the same spacer frame.

A collector groove of the frame placed against a clamping plate such as 5, communicates with a duct 51 arranged in this plate. This duct is connected to piping which passes through the chamber 6 before leaving the enclosure. This piping drains the liquid collected in the collector grooves towards a tank which is not shown.

With each joint plane formed between one face of an electrode plate and one bearing surface of an adjacent frame there is associated a distributor groove referenced 212 or 222. The distributor grooves 212 are associated with the joint bearing surfaces 21 in contact with the anodic faces 71. The distributor grooves 222 are associated with the joint bearing surfaces 22 in contact with the cathodic faces 72. These grooves are inlaid in the plane annular bearing surfaces 21 or 22 of the spacer frames. On opposite sides of each electrode plate are provided two distributor grooves 212 and 222 which are symmetrical with respect to the plane of symmetry of this electrode. These opposite distributor grooves communicate through one or more orifices 74 which pass through the intermediate electrode plate from side to side. Each distributor groove has an annular shape and its perimeter is greater than the perimeter of the bore in the frame but is smaller than the perimeter of the annular collector groove. All of the distributor grooves 212 and 222 are joined together by feed ducts 28 which pass horizontally through the spacer frames. Each feed duct 28 joins together two collector grooves 212 and 222 in one and the same spacer frame, the one being associated with a joint bearing surface such as 21 in contact with the anodic face of an electrode, the other being associated with a joint bearing surface such as 22 in contact with the cathodic face of another electrode. A distributor groove in the frame placed against a clamping plate such as 5 communicates with a duct 52 arranged in this plate. This feed duct 52 is connected to feed piping which passes through the chamber 6 before leaving the enclosure. This feed piping is connected to a supply of demineralized water. The pressure of the demineralized water supplied into the distributor grooves 212 and 222 is higher than the pressure prevailing in the electrolyte contained in the compartments.

Each distributor groove 212 or 222 has an outline such that the electrolyte supply channel 24 is located so as to pass inside the area defined by the perimeter of this distributor groove. Similarly the outline of each distributor groove is such that the gas discharge channels 25 and 26 are located inside the area defined by the perimeter of this groove.

The operation will now be explained. The distributor grooves 212 and 222 contain demineralized water brought through the duct 52 and the ducts 28. The pressure of this demineralized water is higher than the pressure in the electrolyte contained in the channel 24 or the compartments 9 and 10. In the absence of leakage the flow of demineralized water feeding the grooves 212 and 222 is nil and at the outlet from the duct 51 the flow must likewise be nil. In the event that there should develop between the opposite faces 21 and 71 or 22 and 72 of any joint plane an interstice starting from the chamber 6 the nitrogen which would pass through this interstice would be collected in a collector groove 211 or 221. Downstream of the duct 51 it would be possible to detect nitrogen. In the event that an interstice should develop between the grooves the demineralized water would pass through this interstice and would be collected in a collector groove 211 or 221. In the event that an interstice should develop between a groove 212 or 222 and the feed channel 24, demineralized water would be added to the electrolyte and a flow of demineralized water through the duct 52 would be recorded. In the event that an interstice should develop starting from the bore 23, leakage of electrolyte could not be produced. The demineralized water could then penetrate into the compartment corresponding with the interstice created. Leakages of hydrogen and oxygen towards the outside cannot be produced because of the position of the discharge channels 25 and 26 with respect to the distributor grooves.

Of course without departing from the scope of the invention variants and improvements in detail may be conceived of and similarly the use of equivalent means may be envisaged.

I claim:

1. In an electrolytic apparatus including a stack of annular spacer frames, whose annular bearing surfaces indicate joint extending to the exterior of said stack of frames; a series of alternating, spaced electrode plates and diaphragms forming a set of cells, said plates and diaphragms being housed in said stack of annular spacer frames, the space between the electrode plates containing electrolyte under pressure; at least one channel extending through said spacer frames for supplying the electrolyte to said cells; and channels extending through said spacer frames for discharging gases formed during electrolysis, the improvement wherein each of said joints is provided with an annular distributor groove for feeding water at a pressure higher than the feed pressure of the electrolyte and an annular collector groove for discharge of liquid flowing through the joints.

2. An electrolytic apparatus as in claim 1, wherein the perimeter of the distributor groove is less than that of the collector groove.

3. An electrolytic apparatus as in claim 1 or 2 wherein the grooves are arranged in the plane annular bearing surfaces of the frames, facing electrode plates.

4. An electrolytic apparatus as in claim 1, in which each electrolyte inlet channel passes through a stack of spacer frames, the improvement wherein the outline of each distributor groove is such that the electrolyte supply channel is located so as to pass inside the area defined by the perimeter of this groove.

5. An electrolytic apparatus as in claim 1, in which the gas discharge channels pass through a stack of spacer frames, the improvement wherein the outline of each distributor groove is such that the said gas discharge channels are located so as to pass inside the area defined by the perimeter of this groove.

6. An electrolytic apparatus as in claim 1 wherein the spacer frames are pierced by feed ducts which join together the distributor grooves and by discharge ducts which join together the collector grooves.

7. An electrolytic apparatus as in claim 1 wherein the grooves are provided on opposite sides of the electrodes plates and communicate through orifices which pass through the said electrode plates.

* * * * *